US006478660B2

(12) United States Patent
Hakomori et al.

(10) Patent No.: US 6,478,660 B2
(45) Date of Patent: Nov. 12, 2002

(54) APPARATUS OF AND METHOD FOR POLISHING THE OUTER CIRCUMFERENTIAL PORTIONS OF A CIRCULAR PLATE-SHAPED WORK

(75) Inventors: Shunji Hakomori, Kanagawa (JP); Noriaki Mizuno, Kanagawa (JP); Hiroshi Nishi, Kanagawa (JP)

(73) Assignee: Speedfam Co., Ltd., Kanagawa (JP)

( * ) Notice: Subject to any disclaimer, the term of this patent is extended or adjusted under 35 U.S.C. 154(b) by 0 days.

(21) Appl. No.: 10/053,084

(22) Filed: Nov. 7, 2001

(65) Prior Publication Data

US 2002/0137439 A1 Sep. 26, 2002

(30) Foreign Application Priority Data

Nov. 7, 2000 (JP) ..... 2000-339305

(51) Int. Cl.[7] ..... B24B 7/19

(52) U.S. Cl. ..... 451/44; 451/43; 451/324; 451/398

(58) Field of Search ..... 451/41, 43, 44, 451/268, 269, 195, 209, 210, 324, 325, 397, 398

(56) References Cited

U.S. PATENT DOCUMENTS 3,187,467 A * 6/1965 Cortesi
4,594,814 A * 6/1986 Olszewski et al.
6,045,436 A * 4/2000 Rieger et al. ..... 451/44
6,306,015 B1 * 10/2001 Bushell ..... 451/44
6,325,704 B1 * 12/2001 Brown et al. ..... 451/44
6,371,835 B1 * 4/2002 Flisram et al. ..... 451/48

FOREIGN PATENT DOCUMENTS

| | | |
|---|---|---|
| JP | 02-301135 | 12/1990 |
| JP | 03-026459 | 2/1991 |
| JP | 07-040214 | 2/1995 |

* cited by examiner

*Primary Examiner*—Eileen P. Morgan
(74) *Attorney, Agent, or Firm*—Michael K. Kelly; Snell & Wilmer, LLP

(57) ABSTRACT

A pair of edge polishing members (13*a*, 13*b*) each having a recess arcked working surface (22) are located on both sides of a diameter direction of a circular plate-shaped work (1) which is held by a chuck means (12) and is rotatable therewith, with the axes of the respective polishing members being inclined with respect to the axis (L) of the work (1), in a manner such that the working surface (22) of one edge polishing member (13*a*) gets in contact with the edge portion (2*a*) on the front side of the work (1), while the working surface (22) of the other edge polishing member (13*b*) gets in contact with the edge portion (2*b*) on the back side of the work (1), thereby polishing the two edge portions (2*a*, 2*b*).

9 Claims, 4 Drawing Sheets

APPARATUS OF AND METHOD FOR POLISHING THE OUTER CIRCUMFERENTIAL PORTIONS OF A CIRCULAR PLATE-SHAPED WORK

TECHNICAL FIELD

The present invention relates to an apparatus of and a method for mirror-polishing chamfered outer circumferential edges of a substantially circular plate-shaped work such as a semiconductor wafer, a magnetic disc substrate made of an aluminium or a ceramic, and an optical disc substrate made of a glass.

PRIOR ART

FIG. 8 is a view showing a circular plate-shaped work 1 having chamfered outer circumferential edges 2*a* and 2*b* formed on both the front and back sides of the work. Apparatuses for polishing the outer circumferential edges 2*a* and 2*b* of such a work 1 have been well known, such as those disclosed in Japanese Unexamined Patent Application Publication Nos. 2-301135 and 3-26459. In fact, the known polishing apparatuses are all formed in a manner such that their polishing actions can be produced only by pressing a drum-like or a disc-like polishing member (adhesively covered by a polishing cloth) against the outer circumferential edges of a work. As a result, since the contact between the polishing member and the work is substantially concentrated at only one point, the polishing process has only a low efficiency, thus resulting in a low productivity.

In order to solve the above problems, Japanese Unexamined Patent Application Publication No. 7-40214 has suggested that an improved polishing member (buff) having an arcked working surface be used to polish the outer circumferential edges of a work. With the use of an improved polishing apparatus having such an improved polishing member, since it is allowed to carry out a desired polishing process by virtue of a linear contact between the arcked working surface and the outer circumferential edges of a work, it becomes possible to improve the polishing efficiency, thereby allowing the polishing process to be completed in a shortened time period.

However, the above-described improved polishing apparatus has been found to have the following problems. Namely, the disclosed polishing apparatus is formed in a manner such that the working surface of its polishing member has a recess groove engageable with the outer circumferential portion of a work. By engaging the outer circumferential portion of the work into the recess groove formed on the working surface of the polishing member, the outer circumferential edges 2*a* and 2*b* on both surfaces of the work as well as an outer periphery surface 3 located between the two outer circumferential edges are pressed against the two side walls and the bottom wall of the recess groove, thereby carrying out an instant polishing treatment. In fact, the above construction and the polishing manner have been found to be responsible for the following problems.

(a) Since the outer circumferential edges of the work have all been formed into inclined surfaces, forces produced by the edges and pressing incliningly against the two side walls of the recess groove will be larger than a force produced by the outer periphery surface of the work and pressing perpendicularly against the bottom wall of the recess groove. As a result, the polishing efficiency is low. In particular, if the polishing member has worn away, it will be more difficult to apply a desired polishing load to the edges.

(b) Since the depth and the shape of the recess groove have to be altered in accordance with an outer circumferential shape of the work as well as its edge chamferring angle q, a cutting process for shaping the recess groove will be extremely difficult, rendering it necessary to prepare various different types of polishing members having different depths and different shapes, thus making the production management difficult.

(c) Since during the polishing process the work and the recess groove have to be made mutually coincident in their positions, it is difficult to control the operations of both the work and the recess groove.

DISCLOSURE OF THE INVENTION

It is an object of the present invention to solve the aforementioned problems present in the above-described conventional polishing apparatus, by using an improved polishing member having an arcked working surface, thereby making it possible to effectively and exactly polish the outer circumferential edges of a work, allowing the polishing treatment to be completed in a shortened time.

In order to achieve the above object, a polishing apparatus for polishing outer circumferential portions of a circular plate-shaped work is formed by including a chuck means which is provided for chucking the circular plate-shaped work having chamfered outer circumferential edges formed on the front and back sides thereof and which is also capable of turning the circular plate-shaped work about the axis thereof, the apparatus also including a pair of edge polishing members having arcked working surfaces for polishing the edges, at least one outer periphery surface polishing member having an arcked working surface for polishing the outer periphery surface of the work. Specifically, the pair of edge polishing members are arranged in a manner such that the respective axes thereof are inclined with respect to the axis of the work held on the chuck means, so that the working surface of one polishing member is in contact with the edge on the front side of the work, while the working surface of the other polishing member is in contact with the edge on the back side of the work. In particular, the outer periphery surface polishing member is located in a position different from the edge polishing members, in a manner such that the axis of the outer periphery surface polishing member is parallel to the axis of the work.

With the use of the polishing apparatus of the present invention having the above-described constitution, since the arcked working surfaces of the polishing members can form a linear contact with the outer circumferential portions of the work, and since the pair of polishing members can be exactly and uniformly pressed against the edge portions on both sides of the work, polishing efficiency can be improved, thereby making it possible to complete the polishing treatment in a shortened time. Further, since it is not necessary for the working surface of each polishing member to form a recess groove, the constitution of each polishing member is relatively simple, ensuring that positions effecting contact between the work and polishing members can be easily changed.

According to a detailed embodiment of the present invention, the working surface of each edge polishing member is formed into a recess curved surface capable of forming a linear contact with an edge of the work in an inclined state, while the working surface of the outer periphery surface polishing member is formed into another recess curved surface capable of forming another linear contact with the outer periphery surface of the work, each of the working surfaces is not formed with a recess groove for engaging with an edge portion of the work, thereby making it possible to freely change polishing positions.

According to one embodiment of the present invention, the polishing apparatus has a pair of edge polishing members and a pair of outer periphery surface polishing members, the two pairs of the polishing members are located in different positions with one polishing member being 90 degrees different from another polishing member when arranged around the chuck means, and with two members of each pair facing each other.

According to another embodiment of the present invention, the polishing apparatus has a pair of edge polishing members and one outer periphery surface polishing member, these polishing members are located in different positions with one polishing member being 120 degrees different from another polishing member when arranged around the chuck means.

According to one detailed embodiment of the present invention, the polishing apparatus includes moving mechanisms for moving the edge polishing members in a direction parallel to the axis of the apparatus, linear guide mechanisms for freely movably supporting the edge polishing members so that they are freely movable in a direction perpendicular to the axis of the apparatus, load adding means for urging the respective edge polishing members against the outer circumferential edges of the work, the polishing apparatus includes another moving mechanisms for moving the outer periphery surface polishing members in a direction parallel to the axis of the apparatus, another linear guide mechanisms for freely movably supporting the outer periphery surface polishing members so that they are freely movable in a direction perpendicular to the axis of the apparatus, another load adding means for adding polishing load by urging the respective outer periphery surface polishing members against the outer periphery surface of the work.

Specifically, each of the moving mechanisms for moving the edge polishing members includes a ball screw freely rotatably supported on the apparatus main body and rotatably driven by a motor, a nut member movable back and forth by virtue of the rotation of the ball screw, and a movable table connected with the nut member and integrally movable with the nut member, while each of the linear guide mechanisms is provided to freely movably support a polishing member on a movable table, and each load adding means is formed by an air cylinder or a weight which can pressingly urge a holder.

In particular, each moving mechanism for moving an outer periphery surface polishing member includes a ball screw freely rotatably supported on a movable table and rotatably driven by a motor, a nut member movable back and forth by virtue of the rotation of the ball screw, and a support member connected to and integrally movable with the nut member, the support member supporting one outer periphery surface polishing member, while each linear guide mechanism for guiding an outer periphery surface polishing member is provided to freely movably support a movable table on the apparatus main body, and each load adding means is formed by an air cylinder or a weight which can pressingly urge a holder.

According to another detailed embodiment of the present invention, the polishing apparatus includes moving mechanisms for relatively moving the edge polishing members and the chuck means in a direction of the axis of the work, linear guide mechanisms for freely movably supporting the edge polishing members so that they are freely movable in a direction perpendicular to the axis of the apparatus, load adding means for urging the respective edge polishing members against the outer circumferential edges of the work, the polishing apparatus further includes another moving mechanisms for moving the outer periphery surface polishing members in a direction parallel to the axis of the apparatus, another linear guide mechanisms for freely movably supporting the outer periphery surface polishing members so that they are freely movable in a direction perpendicular to the axis of the apparatus, another load adding means for adding polishing loads by urging the respective outer periphery surface polishing members against the outer periphery surface of the work.

Furthermore, according to the present invention, there is provided a polishing method for polishing outer circumferential portions of a circular plate-shaped work, characterized in that a circular plate-shaped work having chamfered outer circumferential edges is turned about the axis of the work, while at the same time a polishing treatment is performed using a pair of edge polishing members each having an arcked working surface and also using at least one outer periphery surface polishing member, with the axes of the pair of edge polishing members being inclined with respect to the axis of the work held by the chuck means, in a manner such that the working surface of one edge polishing member gets in contact with an edge portion on the front side of the work, while the working surface of the other edge polishing member gets in contact with an edge portion on the back side of the work, and with the axis of the outer periphery surface polishing member being parallel with the axis of the work so as to enable the working surface of the polishing member to get in contact with the outer periphery surface of the work, while at the same time using load adding means to press the edge polishing members and the outer periphery surface polishing member against the work so as to add a desired polishing load, thereby simultaneously polishing the outer circumferential edges and the outer periphery surface of the work by virtue of these polishing members.

DETAILED DESCRIPTION

Figure 1:
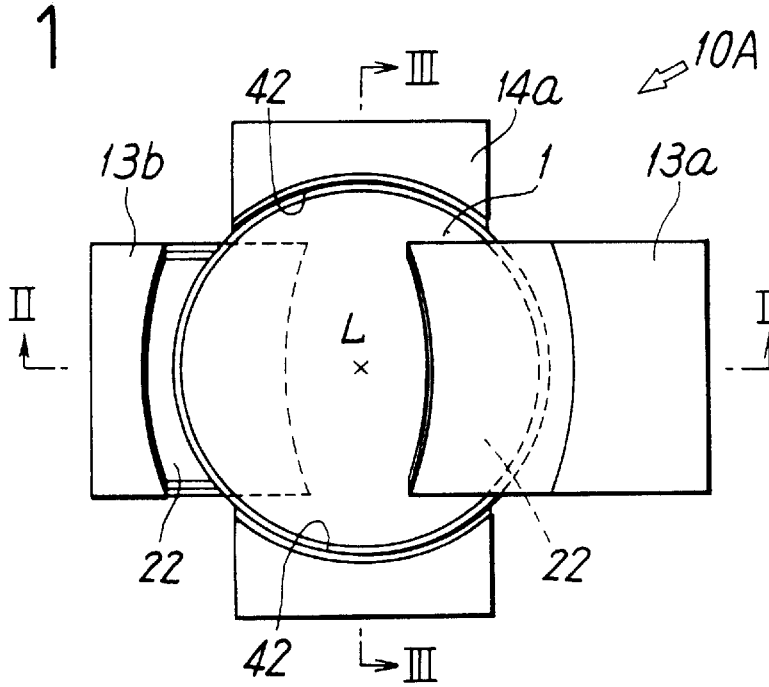
FIG. 1 is a plan view schematically showing a positional relationship between a work and four polishing members in a polishing apparatus formed according to the present invention.
Figure 2:
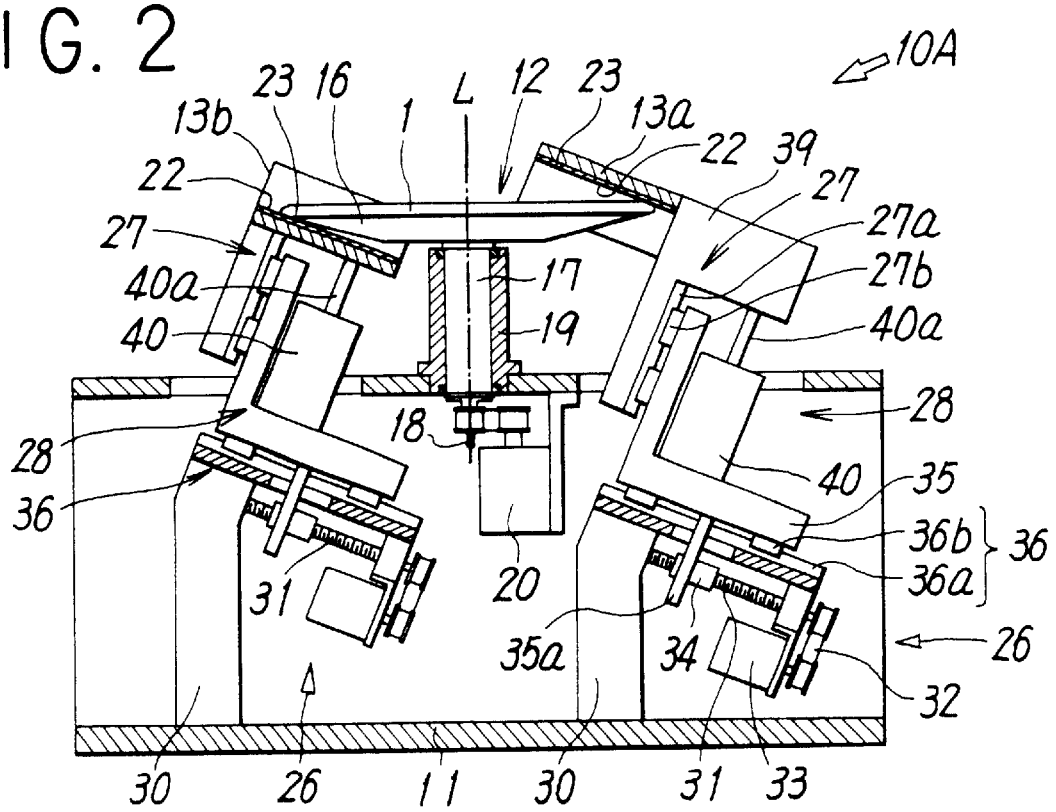
FIG. 2 is a cross sectional view taken along a line II—II in FIG. 1.
Figure 3:
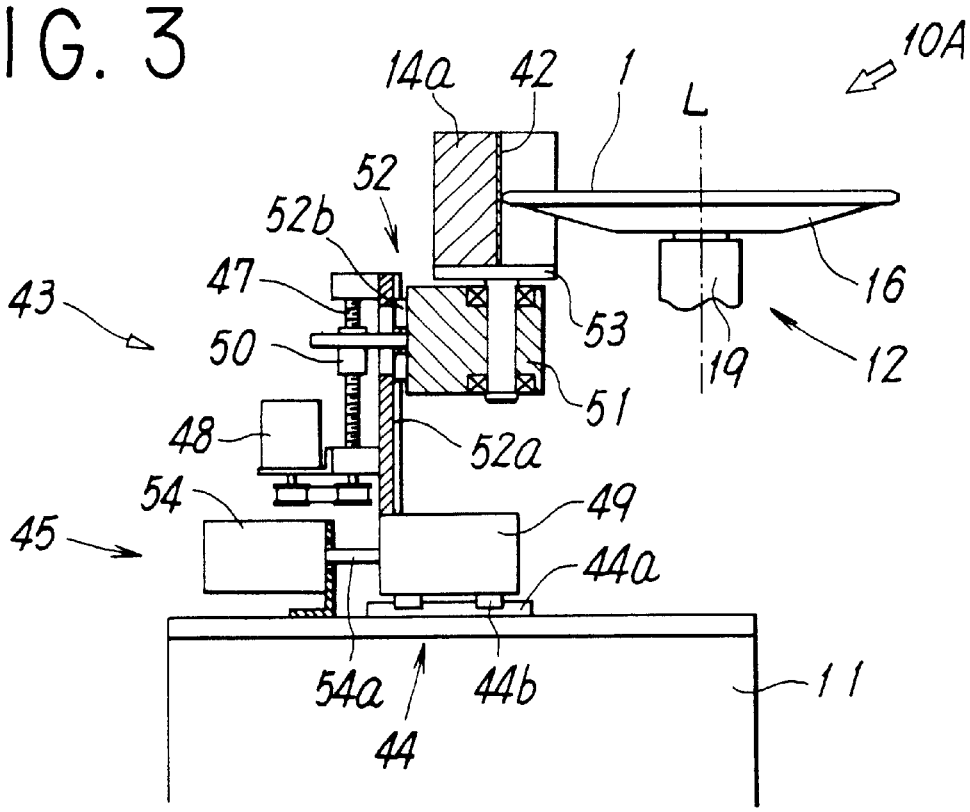
FIG. 3 is a cross sectional view taken along a line III—III in FIG. 1.
Figure 8:
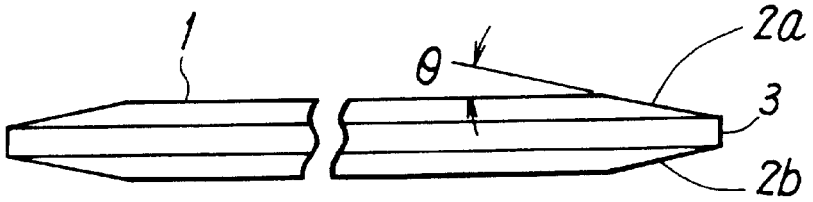
FIG. 8 is a side view showing a work serving as an object to be polished.

In the following, several preferred embodiments of an outer circumferential portion polishing apparatus formed according to the present invention will be described with reference to the accompanying drawings. In detail, FIG. 1 to FIG. 3 are used to show a first embodiment of the invention. As shown in the drawings, a polishing apparatus 10A of the first embodiment includes a chuck means 12 capable of at first chucking and then turning (about an axis L) a circular plate-shaped work 1 having two outer circumferential edges 2*a* and 2*b* formed in a manner as shown in FIG. 8. The polishing apparatus also includes a pair of edge polishing members 13*a* and 13*b* for polishing the edges 2*a* and 2*b* of the work 1 held by the chuck means 12, as well as a pair of outer periphery surface polishing members 14*a* and 14*b* for polishing the outer periphery surface 3 of the work 1.

However, in the present invention, an expression "plate-shaped work" is used to mean not only a completely circular article, but also an article having a linear portion (such as an orientation-flat) and a notch formed on part of the outer circumference thereof, as well as an article having a substantially circular plate shape with a center hole formed in the center thereof. Further, the edges 2*a* and 2*b* do not have to be completely flat and smooth surfaces, but are allowed to be bent so as to be formed into curved surfaces having a convex configuration.

The chuck means 12, as shown in FIG. 2, includes a chuck table 16 formed in a disc-like shape having a diameter slightly smaller than that of the work 1. In fact, the chuck table 16 is so formed that the work 1 can be held horizontally thereon by virtue of a vacuum adsorption, in a manner such that the outer circumferential,portions of the disc-like work 1 is protruding beyond the chuck table 16. Actually, a plurality of adsorbing holes are formed on the upper surface of the chuck table 16, and these adsorbing holes are communicated with a fluid path formed within a support shaft 17 and such a fluid path is further communicated through a connection port 18 to a vacuum pump (not shown). Specifically, the support shaft 17 is supported on the apparatus main body 11 by means of a bearing member 19, in a manner such that it can freely rotate about the axis L. In this way, the support shaft 17 can be driven by a motor 20 so as to rotate in either of the two directions at a predetermined speed.

However, the means for chucking the work 1 on to the above chuck table 16 does not have to be limited to the above-described vacuum adsorption. In fact, it is also possible to employ an electrostatic chuck means formed by making use of an adsorbing force produced by virtue of electrostatics, as well as some other proper chucking methods. When the work 1 is in an annular shape, it is allowed to use an inner circumferential chuck capable of catching in the center hole of the work 1.

The edge polishing members 13*a* and 13*b* are formed by a hard substrate material such as a metal, a synthetic resin and a ceramic, and are each formed with an arcked recess portion. By bonding a polishing pad 23 having a predetermined softness on to the inner surface of each arcked recess portion, a recess arcked working surface 22 can thus be formed which is capable of getting in linear contact with an outer circumferential portion of the work 1. Here, the working surface 22 serves as a surface not involving a recess groove for engaging with a work. However, it is also possible to form a plurality of slurry grooves in a direction parallel to or inclined relative to the axes of the polishing members, so as to effect a smooth flowing of a polishing slurry material. Further, the two edge polishing members 13*a* and 13*b* which have substantially the same structures, as can be seen in FIG. 1, are located on two mutually facing sides (along the diameter direction) of the work 1 held on the chuck means 12. Then, the axes of the respective edge polishing members are made to be inclined with respect to the axis L of the work 1, in a manner such that the working surface 22 of the first polishing member 13*a* can get in contact with the whole width of the front side edge 2*a* of the work 1, while the working surface 22 of the second polishing member 13*b* can get in contact with the whole width of the back side edge 2*b* of the work 1. At this time, the working surfaces 22 of the respective polishing members 13*a* and 13*b* are allowed to get in linear contact with the outer circumferential edges 2*a* and 2*b*, thereby rendering it possible to polish these edges 2*a* and 2*b*.

The arc length of the working surface 22 of each of the polishing members 13*a* and 13*b* is preferred to be ¼ or less of the circumferential length of the work 1, while an arc curvature of each working surface 22 is preferred to be the same as or slightly smaller than an arc curvature of the work 1.

Furthermore, the polishing apparatus 10A includes a pair of moving mechanisms 26, 26, a pair of linear guide mechanisms 27, 27, and a pair of load adding means 28, 28. In detail, the moving mechanisms 26, 26 are provided to move the edge polishing members 13*a*, 13*b* in a direction parallel to the axes thereof, i.e., in a direction along the inclined surfaces of the outer circumferential edges 2*a* and 2*b* of the work 1. The linear guide mechanisms 27, 27 are provided to support the edge polishing members 13*a* and 13*b* so that they can freely move in a direction perpendicular to the axes thereof, i.e., in a direction permitting the polishing members 13*a* and 13*b* to get close to or move away from the outer circumferential edges 2*a* and 2*b* of the work 1. The load adding means 28, 28 are provided to urge the respective polishing members 13*a* and 13*b* towards the outer circumferential edges 2*a* and 2*b* of the work 1, thereby adding a desired load which can cause the polishing members 13*a* and 13*b* to get tight contact with the edges 2*a* and 2*b*.

Specifically, the moving mechanisms 26, 26 are provided to move the polishing members 13*a* and 13*b* at a time the polishing operation is started or ended, so that the polishing members 13*a*and 13*b* can get in contact with or move away from the work 1, and that even during the polishing operation the positions for the polishing members 13*a* and 13*b* to get in contact with the work 1 can be changed. In detail, each of the moving mechanisms 26, 26 includes a ball screw 31 provided on a bracket 30 fixed on the apparatus main body 11, in a manner such that the ball screw 31 is in parallel with the axes of the polishing members 13*a* and 13*b*. Further, each moving mechanism 26 also includes a motor 33 capable of rotating the ball screw 31 through a timing belt 32, a nut member 34 which is engaged with the ball screw 31 and can move back and forth by virtue of the rotation of the ball screw 31, a movable table 35*a* connected with the nut member 34 by way of an arm member 35*a* so as to be movable together with the nut member 34, as well as a sliding mechanism 36 capable of freely movably supporting the movable table 35. Actually, the polishing members 13*a* and 13*b* are supported on the movable tables 35 through the linear guide mechanisms 27. Each sliding mechanism 36 includes a rail 36a provided on a bracket 30 in a manner such that it lies in parallel to the ball screw 31, as well as a slider 36*b* attached on the movable table 35 and freely slidable along the rail 36*a*.

Each of the linear guide mechanisms 27 includes a rail 27*a* provided on a holder 39 holding the polishing member 13*a* or the polishing member 13*b* and extending in a direction perpendicular to the axes of the polishing members

13*a* and 13*b*, as well as a slider 27*b* attached on the movable table 35 and freely slidable along the rail 27*a*. On the other hand, the rail 27*a* and the slider 27*b* can also be arranged in an adverse order, by providing the rail 27*a* on the movable table 35 and providing the slider 27*b* on the holder 39.

Each load adding means 28 is formed by an air cylinder 40. Such an air cylinder 40 is installed on one movable table 35, with its piston rod 40*a* connected to the polishing member 13*a* or the polishing member 13*b*. An amount of compressed air having an adjusted pressure is supplied to or discharged from the air cylinder 40 to cause piston rod 40*a* to extend or retract. In this way, the polishing members 13*a* and 13*b* can be pressed against the work 1, making it sure to use an adjusted air pressure to apply a desired polishing load for pressing the polishing members 13*a* and 13*b* against the work 1.

In this way, during the polishing treatment or at the beginning of the polishing treatment, the above-described edge polishing members 13*a* and 13*b* are allowed to properly change the positions of their working surfaces 22 (which are in contact with the work 1) in a manner shown in FIG. 2. In fact, this can be effected by rotating the ball screws 31 of the moving mechanisms 26 so as to move the polishing members 13*a* and 13*b* in the rightward or leftward direction along the respective axes thereof. At this time, each load adding means 28 is operated so that its air cylinder 40 is controlled in accordance with the movement of the polishing member 13*a* or 13*b*, in a manner such that an extension length of its piston rod 40*a* is adjusted to obtain desired polishing load. Further, at the beginning or at the end of the polishing treatment, by moving the first polishing member 13*a* in the rightward direction and moving the second polishing member 13*b* in the leftward direction, the polishing members 13*a* and 13*b* can be separated from the work 1, thereby permitting the work 1 to be moved to or taken away from the chuck means 12. At this time, the second polishing member 13*b* in contact with the edge 2*b* on the back side (lower surface) of the work 1 can be maintained as such without any movement. Alternatively, the piston rod 40*a* of the load adding means 28 is retracted so as to separate the second polishing member 13*b* from the edge 2*b*. At this moment, only the first polishing member 13*a*in contact with the edge 2*a* on the front side (upper surface) of the work 1 is caused to move to a position separated from the work 1 by operating the moving mechanism 26.

Next, the outer periphery surface polishing members 14a and 14*b* will be described with reference to FIG. 3 which shows only one polishing member 14*a*. As shown in the drawing, an outer periphery surface polishing member has a recess arcked working surface 42 which is substantially the same as that of each of the edge polishing members 13*a*, 13*b* and is in fact a surface not formed with polishing grooves. In detail, the outer periphery surface polishing members 14*a* and 14*b* are located in positions separated by 90 degrees from the above described edge polishing members 13*a* and 13*b*, with the respective axes thereof arranged in parallel with the axis L of the work 1, and with one outer periphery surface polishing member located on either side of the diameter direction of the work 1. In this manner, by virtue of a right angle contact between the work 1 and the working surface 42 of each outer periphery surface polishing member, it is allowed to effect a linear contact between the working surface 42 of the polishing member and the outer periphery surface 3 of the work 1, thereby effecting a desired polishing treatment (refer to FIG. 8).

The arc length of the working surface of each of the outer periphery surface polishing members 14*a* and 14*b* is preferred to be ¼ or less of the circumferential length of the work 1. On the other hand, although it is preferable that the arc curvature of the working surface 42 be made to be the same as the circumferential curvature of the work 1, such an arc curvature is also allowed to be slightly smaller than such a circumferential curvature.

Moreover, each of the outer periphery surface polishing members 14*a* and 14*b* is associated with a moving mechanism 43 for moving an outer periphery surface polishing member in a direction parallel to its axis, a linear guide mechanism 44 for freely movably supporting the outer periphery surface polishing member in a direction perpendicular to its axis, as well as a load adding means 45 for adding a polishing load by pressing the outer periphery surface polishing member in a direction towards the work 1.

Each of the moving mechanisms 43, 43 includes a ball screw 47 arranged in parallel with the axes of the polishing members 14*a* and 14*b*, a motor 48 for rotating the ball screw 47, a movable table 49 supporting the ball screw 47 and the motor 48, a nut member 50 which is engaged with the ball screw 47 and can move back and forth by virtue of the rotation of the ball screw 47, a support member 51 connected with the nut member 50 and movable together with the nut member, a sliding mechanism 52 capable of guiding the support member 51. The polishing member 14*a* or 14*b* is supported on the support member 51 through a holder 53. Each sliding mechanism 52 includes a rail 52*a* provided on the movable table 49 in a manner such that it is in parallel with the ball screw 47, as well as a slider 52*b* attached on the support member 51 and freely slidable along the rail 52*a*.

Each of the linear guide mechanisms 44 includes a rail 44*a* provided on the apparatus main body 11 and extending in a direction perpendicular to the axes of the polishing members 14*a* and 14*b*, as well as a slider 44*b* attached on the movable table 49 and freely slidable along the rail 44*a*.

Each load adding means 45 is formed by an air cylinder 54. Such an air cylinder 54 is attached on the apparatus main body 11, with its piston rod 54*a* connected to the movable table 49. Accordingly, it is possible to make use of an air pressure to apply a desired polishing load for pressing the polishing members 14*a* and 14*b* against the work 1.

In this way, during the polishing treatment or at the beginning of the polishing treatment, the above-described outer periphery surface polishing members 14*a* and 14*b*, are allowed to properly change the positions of their working surfaces 42 (which are in contact with the work 1) in a manner shown in FIG. 3, by vertically moving the moving mechanism 43. Further, at the beginning or at the end of the polishing treatment, by retracting the piston rod 54*a* of the air cylinder 54 of the load adding means 45, it is possible to separate the polishing members 14*a* and 14*b* from the work 1, thereby permitting the work 1 to be moved to or taken away from the chuck means 12.

The polishing apparatus having the above-described constitutions can be used to carry out a polishing treatment, by effecting a linear contact between the outer circumferential portions of the work 1 and the arcked working surfaces 22 of the edge polishing members 13*a*, 13*b*, as well as the working surfaces 42 of the outer periphery surface polishing members 14*a*, 14*b*. In this way, it is possible to improve the polishing efficiency so as to complete the polishing of the edges 2*a*, 2*b* and the outer periphery surface 3 of a work 1 within a shortened time period. In particular, by inclining the pair of the edge polishing members 13*a* and 13*b* with respect to the axis L of the work 1, one polishing member 13*a* may be pressed against the front side circumferential edge 2*a* of the work 1, while the other polishing member 13*b* may be pressed against the back side circumferential edge 2*b* of the work 1, so that it is possible to exactly and uniformly press the polishing members 13*a* and 13*b* against the two circumferential edges 2*a* and 2*b* of the work 1. In this manner, since it is not necessary to form recess grooves on the working surfaces 22 and 42, these polishing members can be made simple in their structures and it is allowed to dispense with the cutting process for forming the recess grooves. Further, it is possible to alter the contact positions between the work 1 and the respective polishing members.

Figure 4:
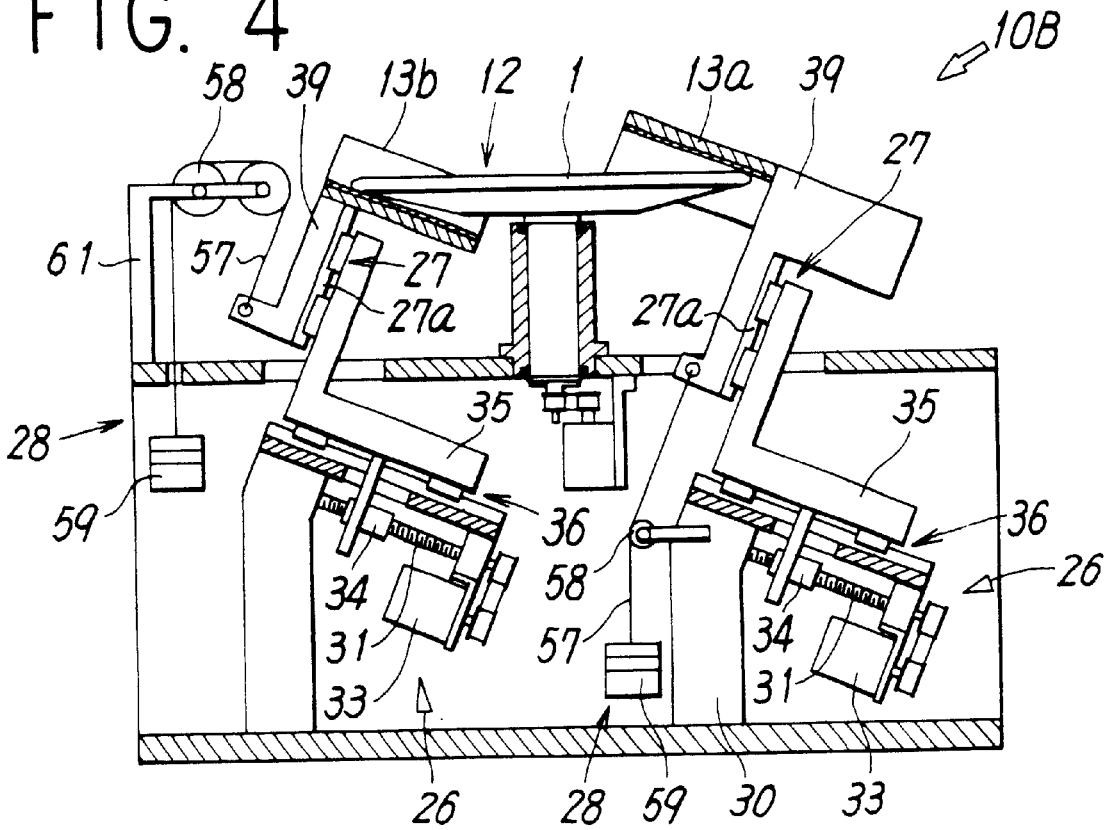
FIG. 4 is a cross sectional view schematically showing an edge polishing system formed according to a second embodiment of the present invention.
Figure 5:
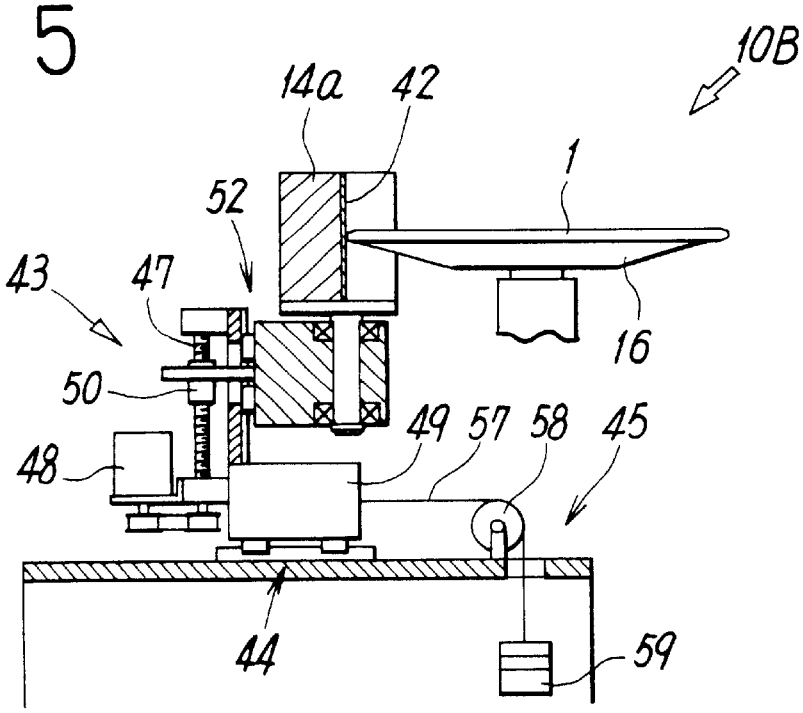
FIG. 5 is a cross sectional view schematically showing an outer periphery surface polishing system formed according to the second embodiment of the present invention.

FIG. 4 and FIG. 5 are used to show a polishing apparatus 10B formed according to a second embodiment of the present invention, with an edge polishing system being illustrated separately from an outer periphery surface polishing system. In fact, the polishing apparatus 10B differs from the polishing apparatus 10A of the above first embodiment in that each of load adding means 28 and load adding means 45 involved in the respective polishing systems is formed by a weight.

In detail, when using load adding means 28 in the edge polishing system shown in FIG. 4, one end of a string 57 is connected with a holder 39 supporting the first polishing member 13*a*, while the other end of the string 57 is caused to extend downwardly in an inclined direction parallel to a rail 27*a* of a linear guide mechanism 27, and then get engaged with a pulley 58 attached on a bracket 30, thereby changing the orientation of the string to a downward vertical direction, with its lower end being connected to a weight 59 which is hung therefrom and is adjustable in its weight. By virtue of the weight 59, the first polishing member 13*a* can be urged along the rail 27*a* so as to move downwardly in an inclined direction, thereby making it possible to set a desired polishing weight on the first polishing member 13*a*. On the other hand, with regard to the second polishing member 13*b*, a string 57 connected through one end thereof with a holder 39 is directed upwardly in an inclined direction parallel to a rail 27*a* of another linear guide mechanism 27, and then get engaged with a pulley 58 supported on the apparatus main body 11 by virtue of a bracket 61 so as to change its forward orientation to a downward vertical direction. A weight 59 is hung from the lower end of the string 57. By virtue of the weight 59, the second polishing member 13*b* can be urged upwardly in an inclined direction, thereby making it possible to set a desired polishing weight on the second polishing member.

Furthermore, with regard to the load adding means 45 for use in the outer periphery surface polishing system, as shown in FIG. 5 which illustrates only one polishing member 14*a*, one end of the string 57 is connected to an end face of a movable table 49, while the other end of the string 57 is caused to at first extend horizontally towards a chuck means 12 and then get engaged with the pulley 58 fixed on the apparatus main body 11 so as to change its forward orientation into a downward vertical direction. A weight 59 is hung from the lower end of the string 57. By virtue of the weight 59, the movable table 49 can be urged towards the work 1, thereby making it possible to set a desired polishing weight on the polishing member.

However, when each of the load adding means 28 and the load adding means 45 is formed by the weight 59, it is preferable to provide mechanisms capable of moving back the holder 39 and the movable table 49 by a certain distance and then stopping them, so that during a non-polishing time, the polishing members 13*a*, 13*b*and 14*a*, 14*b* can be kept in positions separated from the work 1.

The second embodiment's other constitutions and operations than those described in the above are substantially the same as those of the first embodiment, with the same identical elements being represented by the same reference numerals as used in the first embodiment, and the similar explanations thereof being omitted.

Figure 6:
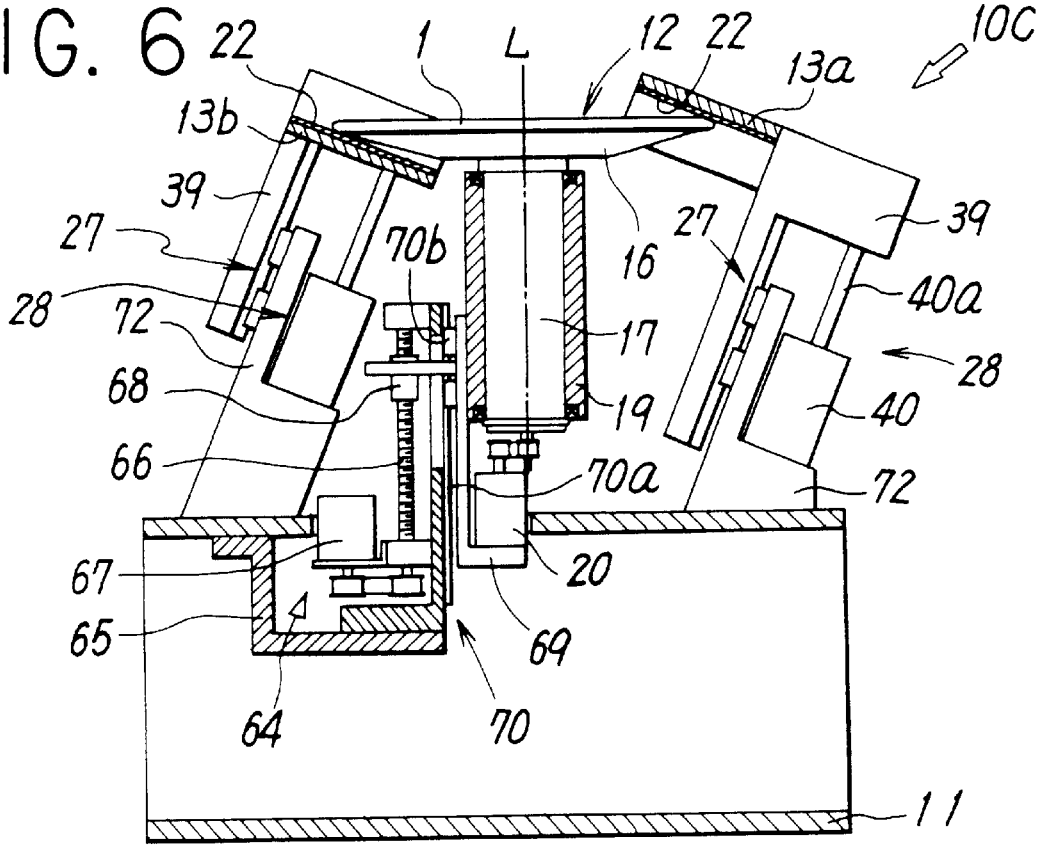
FIG. 6 is a cross sectional view schematically showing an edge polishing system formed according to a third embodiment of the present invention.

FIG. 6 is used to show a polishing apparatus 10C formed according to a third embodiment of the present invention, representing an edge polishing system. In fact, the polishing apparatus 10C differs from the polishing apparatus 10A of the above first embodiment in that the chuck means 12 can move in the direction of the axis L by virtue of a moving mechanism 64.

The moving mechanism 64 includes a ball screw 66 provided on the bracket 65 of the apparatus main body 11 in a manner such that it is in parallel with the axis L of the work 1, a motor 67 for rotating the ball screw 66, a nut member 68 engaged with the ball screw 66 and movable back and forth by virtue of the rotation of the ball screw 66, a support table 69 connected with the nut member 68 so as to be integrally movable with the nut member, and a sliding mechanism 70 capable of freely movably supporting the support table 69. Mounted on the support table 69 is a bearing member 19 capable of freely rotatably supporting the support shaft 17 of the chuck means 12, as well as a motor 20 for driving the support shaft 17. The sliding mechanism 70 includes a rail 70*a* provided on the bracket 65 in a manner such that it is in parallel with the ball screw 66, as well as a slider 70*b* attached on the support member 51 in a manner such that it is slidable along the rail 70*a*.

On the other hand, both of the two edge polishing members 13*a* and 13*b* are supported by the linear guide mechanisms 27 provided between the brackets 72 of the apparatus main body 11 and the holders 39, in a manner such that they are freely movable in a direction perpendicular to their axes. Further, air cylinders 40 and piston rods 40*a* together forming the load adding means 28 are provided between the brackets 72 and the holders 39.

In this third embodiment, if the piston rod 40*a* of one load adding means 28 is extended while the piston rod 40*a* of the other load adding means 28 is retracted, and if the chuck means 12 is moved in the direction of the axis L, it is allowed to change the contact positions for the work 1 to get in contact with the working surfaces 22 of the respective polishing members 13*a* and 13*b*. Further, an operation for moving the work 1 towards or from the chuck table 16 can be carried out by extending the piston rod 40*a* in the vicinity of the polishing member 13*a* while retracting the piston rod 40*a* in the vicinity of the polishing member 13*b*, thereby separating the polishing members 13*a* and 13*b* from the work 1.

In this embodiment shown in the drawing, the chuck means 12 is so constructed that it is freely movable in the direction of the axis L by virtue of the moving mechanism 64. On the other hand, it is also possible for the polishing members 13*a* and 13*b* to freely move in the direction of the axis L by supporting the bracket 72 on the moving mechanism 64.

The third embodiment's other constitutions and operations than those described in the above, including the outer periphery surface polishing system, are substantially the same as those of the first embodiment, with the same identical elements being represented by the same reference numerals as used in the first embodiment, and the similar explanations thereof being omitted.

Figure 7:
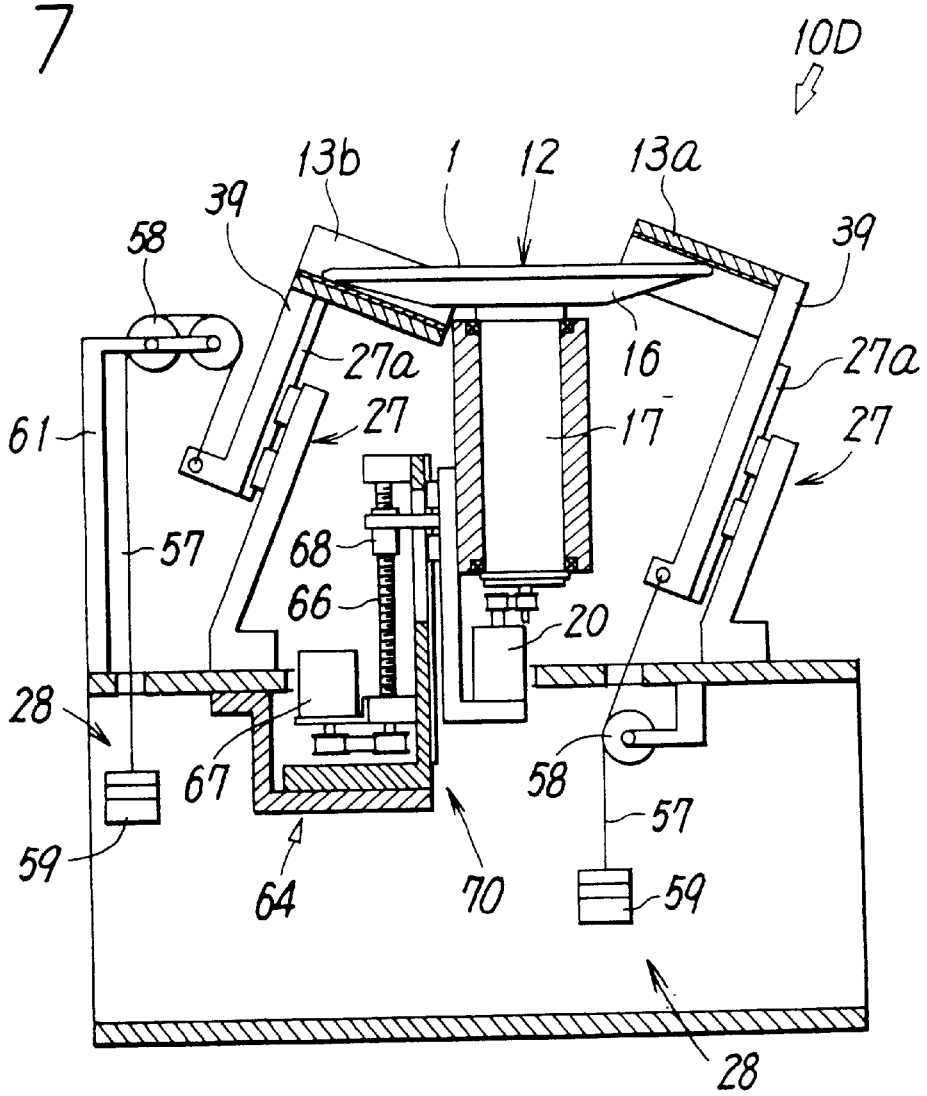
FIG. 7 is a cross sectional view schematically showing an outer periphery surface polishing system formed according to a fourth embodiment of the present invention.

FIG. 7 is used to show a polishing apparatus 10D formed according to a fourth embodiment of the present invention, but with only one edge polishing system illustrated in the drawing. In fact, the polishing apparatus 10D differs from the polishing apparatus of the third embodiment in that its load adding means 28 is formed by a weight.

Namely, one end of a string 57 is connected with a holder 39 supporting the first polishing member 13*a*, while the other end of the string 57 is caused to extend downwardly in an inclined direction parallel to a rail 27*a* of a linear guide mechanism 27, and then get engaged with a pulley 58 attached on the apparatus main body, thereby changing the forward orientation of the string to a downward vertical direction, with its lower end being connected to a weight 59 hung therefrom. On the other hand, with regard to the second polishing member 13*b*, a string 57 connected through one end thereof to a holder 39 is directed upwardly in an inclined direction parallel to a rail 27*a* of another linear guide mechanism 27, and then get engaged with pulleys 58 supported on the apparatus main body 11 by virtue of a bracket 61, thereby changing its forward orientation to a downward vertical direction. A weight 59 is thus hung from the lower end of the string.

The fourth embodiment's other constitutions and operations than the edge polishing system are substantially the same as those of the third embodiment, with the same identical elements being represented by the same reference numerals as used in the third embodiment, and the similar explanations thereof being omitted. Further, an outer periphery surface polishing system of this embodiment is substantially the same as that of the second embodiment shown in FIG. 5.

Although the above-described respective embodiments involve using a pair of edge polishing members 13*a*, 13*b* and a pair of outer periphery surface polishing members 14*a*, 14*b* in a manner such that 90-degree angles are formed between the orientations of the edge polishing members and the orientations of the outer periphery surface polishing members, it is also possible that only one edge polishing member and only one outer periphery surface polishing member are used. Namely, it is allowed to use only one edge polishing member 13*a* and only one outer periphery surface polishing member 14*a*, or one edge polishing member 13*a* and two outer periphery surface polishing members 14*a* and 14*b* . Further, it is also possible to use two edge polishing members 13*a*, 13*b* and one outer periphery surface polishing member 14*a* . In the case where two edge polishing members 13*a*, 13*b* and one outer periphery surface polishing member 14*a* are used, it is allowed to omit one of the two outer periphery surface polishing members 14*a* and 14*b* . On the other hand, it is further possible that the two edge polishing members 13*a*, 13*b* and one outer periphery surface polishing member 14*a* are equivalently arranged around the outer circumference of the work 1, at an angular interval of 120 degrees.

Alternatively, a polishing pad 23 is adhesively attached to the working surface 22 of each of the edge polishing members 13*a* and 13*b*, thereby forming polishing members each having a desired thickness and a desired softness, in a manner such that ½ width of the outer periphery surface of the work 1 will sink into the polishing members. In this way, it is possible to use one polishing member 13*a* to polish the edge 2*a* on the front side of the work 1, as well as half of the outer periphery surface close to the front side of the work 1, and to use the other polishing member 13*b* to polish the edge 2*b* on the back side of the work 1, as well as half of the outer periphery surface close to the back side of the work 1. As a result, it is allowed to omit the outer periphery surface polishing members.

Here, the pad 23 to be adhesively attached to the working surface of each polishing member may be directly attached to the working surface of the polishing member so as to form a one-layer structure. On the other hand, it is also possible that such a pad can be attached to the working surface, with a resilient sheet such as a synthetic rubber sheet or a sponge sheet interposed therebetween, thereby forming a two-layer structure.

Furthermore, the cross section of each of the polishing members 13*a*, 13*b* and 14*a*, 14*b* should not be limited to a circular arcked configuration. In fact, it is possible for such a cross section to be a recessed curved surface involving an arcked portion other than a circular arcked portion, such as a part of an ellipse and some other curved surface. In conclusion, such a cross section may be any sort of recessed curved surface, provided that it will effect a linear contact with the edges and the outer periphery surface of the work 1.

In addition, although it has been described in the above that the work 1 is horizontally chucked by the chuck means 12 in a manner such that it can be turned about the axis L, it is also possible that an orientation of the work 1 may be non-horizontal. For example, the orientations of the edge polishing members 13*a* and 13*b* may be made vertical, while the work 1 is inclined so as to satisfy the attitude of the edge polishing members.

In this way, according to the present invention, polishing members having arcked working surfaces are used and these polishing members are inclined with respect to the axis of the work so as to enable the working surfaces of the polishing members to get contact with the outer circumferential edges of the work. Therefore, since the outer circumferential edges of the work are polished in this manner, it is sure to exactly press the polishing members against the edges of the work with a predetermined pressure, thus rendering it possible to effect a linear contact between the work and polishing members, thereby making it sure to complete polishing treatment of the edges with a high efficiency during a short time.

What is claimed is:

1. A polishing apparatus for polishing outer circumferential portions of a circular plate-shaped work, said apparatus including a chuck means which is provided for chucking the circular plate-shaped work having chamfered outer circumferential edges formed on the front and back sides thereof and which is also capable of turning the circular plate-shaped work about the axis thereof, the apparatus also including a pair of edge polishing members having arcked working surfaces for polishing the edges, at least one outer periphery surface polishing member having an arcked working surface for polishing the outer periphery surface of the work, wherein the pair of edge polishing members are arranged in a manner such that the respective axes thereof are inclined with respect to the axis of the work held on the chuck means, so that the working surface of one polishing member is in contact with the edge on the front side of the work, while the working surface of the other polishing member is in contact with the edge on the back side of the work, wherein the outer periphery surface polishing member is located in a position different from the edge polishing members, in a manner such that the axis of the outer periphery surface polishing member is parallel to the axis of the work.

2. A polishing apparatus according to claim 1, wherein the working surface of each edge polishing member is formed into a recess curved surface capable of forming a linear contact with an edge of the work in an inclined state, while the working surface of the outer periphery surface polishing member is formed into another recess curved surface capable of forming another linear contact with the outer periphery surface of the work, each of the working surfaces is not formed with a recess groove for engaging with an edge portion of the work, thereby making it possible to freely change polishing positions.

3. A polishing apparatus according to claim 1, wherein said polishing apparatus has a pair of edge polishing members and a pair of outer periphery surface polishing members, the two pairs of the polishing members are located in different positions with one polishing member being 90 degrees different from another polishing member when arranged around the chuck means, and with two members of each pair facing each other.

4. A polishing apparatus according to claim 1, wherein said polishing apparatus has a pair of edge polishing members and one outer periphery surface polishing member, these polishing members are located in different positions with one polishing member being 120 degrees different from another polishing member when arranged around the chuck means.

5. A polishing apparatus according to claim 1, wherein said polishing apparatus includes moving mechanisms for moving the edge polishing members in a direction parallel to the axis of the apparatus, linear guide mechanisms for freely movably supporting the edge polishing members so that they are freely movable in a direction perpendicular to the axis of the apparatus, load adding means for urging the respective edge polishing members against the outer circumferential edges of the work, said polishing apparatus includes another moving mechanisms for moving the outer periphery surface polishing members in a direction parallel to the axis of the apparatus, another linear guide mechanisms for freely movably supporting the outer periphery surface polishing members so that they are freely movable in a direction perpendicular to the axis of the apparatus, another load adding means for adding polishing load by urging the respective outer periphery surface polishing members against the outer periphery surface of the work.

6. A polishing apparatus according to claim 5, wherein each of the moving mechanisms for moving the edge polishing members includes a ball screw freely rotatably supported on the apparatus main body and rotatably driven by a motor, a nut member movable back and forth by virtue of the rotation of the ball screw, and a movable table connected with the nut member and integrally movable with said nut member, while each of the linear guide mechanisms is provided to freely movably support a polishing member on a movable table, and each load adding means is formed by an air cylinder or a weight which can pressingly urge a holder.

7. A polishing apparatus according to claim 5, wherein each moving mechanism for moving an outer periphery surface polishing member includes a ball screw freely rotatably supported on a movable table and rotatably driven by a motor, a nut member movable back and forth by virtue of the rotation of the ball screw, and a support member connected to and integrally movable with the nut member, said support member supporting one outer periphery surface polishing member, while each linear guide mechanism for guiding an outer periphery surface polishing member is provided to freely movably support a movable table on the apparatus main body, and each load adding means is formed by an air cylinder or a weight which can pressingly urge a holder.

8. A polishing apparatus according to claim 1, wherein the polishing apparatus includes moving mechanisms for relatively moving the edge polishing members and the chuck means in a direction of the axis of the work, linear guide mechanisms for freely movably supporting the edge polishing members so that they are freely movable in a direction perpendicular to the axis of the apparatus, load adding means for urging the respective edge polishing members against the outer circumferential edges of the work, the polishing apparatus further includes another moving mechanisms for moving the outer periphery surface polishing members in a direction parallel to the axis of the apparatus, another linear guide mechanisms for freely movably supporting the outer periphery surface polishing members so that they are freely movable in a direction perpendicular to the axis of the apparatus, another load adding means for adding polishing loads by urging the respective outer periphery surface polishing members against the outer periphery surface of the work.

9. A polishing method for polishing outer circumferential portions of a circular plate-shaped work, characterized in that a circular plate-shaped work having chamfered outer circumferential edges is turned about the axis of the work, while at the same time a polishing treatment is performed using a pair of edge polishing members each having an arcked working surface and also using at least one outer periphery surface polishing member, with the axes of the pair of edge polishing members being inclined with respect to the axis of the work held by the chuck means, in a manner such that the working surface of one edge polishing member gets in contact with an edge portion on the front side of the work, while the working surface of the other edge polishing member gets in contact with an edge portion on the back side of the work, and with the axis of the outer periphery surface polishing member being parallel with the axis of the work so as to enable the working surface of the polishing member to get in contact with the outer periphery surface of the work, while at the same time using load adding means to press the edge polishing members and the outer periphery surface polishing member against the work so as to add a desired polishing load, thereby simultaneously polishing the outer circumferential edges and the outer periphery surface of the work by virtue of these polishing members.

* * * * *